US009208684B2

(12) United States Patent
Lee et al.

(10) Patent No.: US 9,208,684 B2
(45) Date of Patent: Dec. 8, 2015

(54) TRAVEL OPTIMIZATION SYSTEM

(71) Applicants: Verizon New Jersey Inc., Newark, NJ (US); Cellco Partnership, Basking Ridge, NJ (US); Verizon Patent and Licensing Inc., Basking Ridge, NJ (US)

(72) Inventors: Woo Beum Lee, Basking Ridge, NJ (US); Nader Gharachorloo, Ossining, NY (US); Michelle Felt, Randolph, NJ (US)

(73) Assignees: Verizon Patent and Licensing Inc., Basking Ridge, NJ (US); Verizon New Jersey Inc., Newark, NJ (US); Cellco Partnership, Basking Ridge, NJ (US)

( * ) Notice: Subject to any disclaimer, the term of this patent is extended or adjusted under 35 U.S.C. 154(b) by 224 days.

(21) Appl. No.: 13/666,235

(22) Filed: Nov. 1, 2012

(65) Prior Publication Data

US 2014/0118168 A1 May 1, 2014

(51) Int. Cl.
*G08G 1/0967* (2006.01)

(52) U.S. Cl.
CPC .... *G08G 1/096725* (2013.01); *G08G 1/096741* (2013.01); *G08G 1/096783* (2013.01)

(58) Field of Classification Search
CPC ..... G08G 1/096725; G08G 1/096741; G08G 1/096783
USPC ..... 340/905, 910, 670; 710/460, 446, 1, 710/408–410
See application file for complete search history.

(56) References Cited

U.S. PATENT DOCUMENTS

| | | | | |
|---|---|---|---|---|
| 6,516,262 | B2 * | 2/2003 | Takenaga et al. | 701/96 |
| 7,643,834 | B2 * | 1/2010 | Ioppe et al. | 455/456.3 |
| 8,797,185 | B2 * | 8/2014 | Cho et al. | 340/932 |
| 2003/0063015 | A1 * | 4/2003 | Ebner et al. | 340/907 |
| 2005/0134478 | A1 * | 6/2005 | Mese et al. | 340/901 |
| 2010/0070128 | A1 * | 3/2010 | Johnson | 701/33 |
| 2011/0037619 | A1 * | 2/2011 | Ginsberg et al. | 340/910 |
| 2011/0090094 | A1 * | 4/2011 | Yamada | 340/905 |
| 2011/0098916 | A1 * | 4/2011 | Jang | 701/201 |
| 2011/0187547 | A1 * | 8/2011 | Kweon | 340/670 |
| 2012/0078512 | A1 * | 3/2012 | Schunder et al. | 701/446 |
| 2012/0169517 | A1 * | 7/2012 | Cho et al. | 340/932 |
| 2013/0110316 | A1 * | 5/2013 | Ogawa | 701/1 |
| 2013/0184985 | A1 * | 7/2013 | Bollars | 701/410 |
| 2014/0046581 | A1 * | 2/2014 | Ota et al. | 701/408 |

* cited by examiner

*Primary Examiner* — Benjamin C Lee
*Assistant Examiner* — Chico A Foxx

(57) ABSTRACT

A device may obtain information associated with a traffic light. The traffic light may control a flow of traffic associated with a first location. The device may obtain travel information associated with a mobile device and determine, based on the travel information, that the mobile device is located at a second location, that is different from the first location, and is traveling toward the first location. The device may determine a projected status of the traffic light based on the information associated with the traffic light and the travel information. The projected status of the traffic light indicating a status of the traffic light at a time the mobile device is projected to arrive at the first location. The device may transmit information identifying the projected status to the mobile device.

20 Claims, 14 Drawing Sheets

TRAVEL OPTIMIZATION SYSTEM

BACKGROUND

A traffic light controls traffic flowing through a particular intersection. A traffic light illuminates a series of different color lenses to cause traffic moving in one direction through the intersection to stop prior to crossing the intersection so that traffic moving in another direction may cross through the intersection unimpeded. Stopping at a traffic light may increase a person's travel time and decrease the fuel efficiency of the person's vehicle.

DETAILED DESCRIPTION OF PREFERRED EMBODIMENTS

The following detailed description refers to the accompanying drawings. The same reference numbers in different drawings may identify the same or similar elements.

Systems and/or methods described herein may gather and collect travel information and traffic pattern information to produce travel optimization data. The travel optimization data may be output to a user and allow the user to optimize travel time, increase fuel efficiency, and/or identify safety concerns.

Figure 1A:
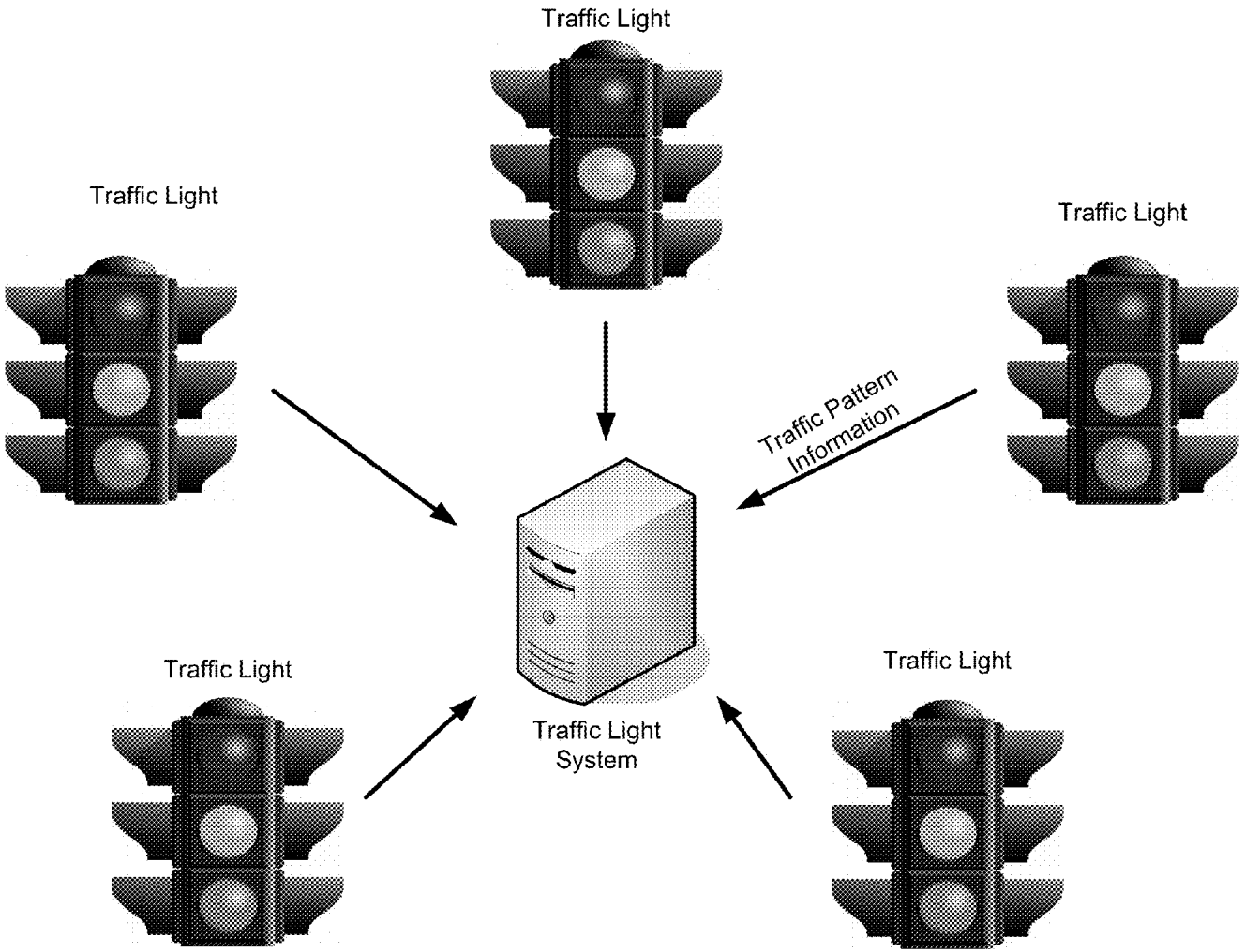
FIGS. 1A and 1B are diagrams illustrating an overview of a traffic light system according to implementations described herein.
Figure 1B:
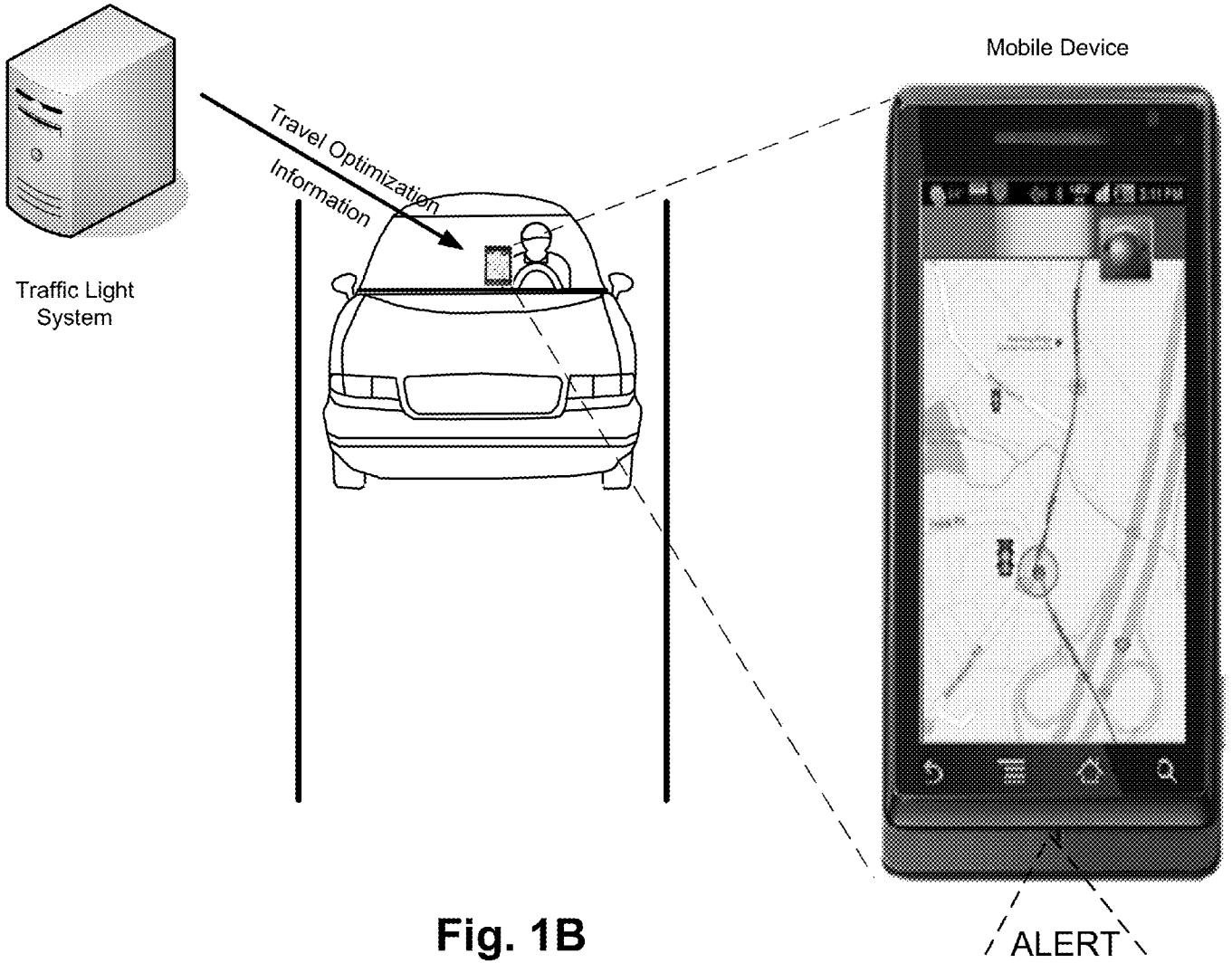

FIGS. 1A and 1B provide diagrams illustrating an overview of a traffic light system according to implementations described herein. Referring to FIG. 1A, traffic lights may use traffic pattern data to control a flow of traffic through a particular intersection or along a roadway. Each of the traffic lights may use the traffic pattern data to control a status of the traffic light (e.g., determine a time for illuminating a particular colored lens of the traffic light). Traffic pattern information may subsequently be communicated between the traffic light and a traffic light system. The traffic pattern information may include information identifying a current and/or projected status of the traffic lights and/or information for modifying the traffic pattern data.

Referring to FIG. 1B, the traffic light system may collect and process the traffic pattern information from traffic lights. The traffic light system may use the processed traffic pattern information to determine traffic flow data based on travel information obtained from a mobile device. The traffic flow data may include, for example, information for determining travel optimization data that may be output by the mobile device as, or in conjunction with, an audible and/or visual alert. The travel optimization data can be used by a user of the mobile device to optimize travel time as well as inform the user of potential safety concerns.

The traffic optimization data may include information that can be used by the user to decrease the amount of time the user spends in their vehicle stopped at a traffic light. For example, based on the travel optimization data the user may determine that at their current speed they will reach a particular traffic light while the status of the traffic light is red (e.g., the traffic light is causing a red colored lens to be illuminated). The user may determine to speed up or slow down to reach the traffic light while the status of the traffic light is green (e.g., the traffic light is causing a green colored lens to be illuminated) and avoid a "stop and go" situation caused by having to stop at the traffic light. By avoiding stop and go situations, the user may decrease an amount of time required to travel from one destination to another and increase fuel efficiency by being able to maintain a constant speed as they travel.

Further, the traffic optimization data may increase travel safety by notifying the user of potential safety issues. For example, the travel optimization data may notify the user of upcoming changes in the status of the traffic light, on-coming vehicles that may not be visible due to an obscured line of sight, etc.

Figure 2:
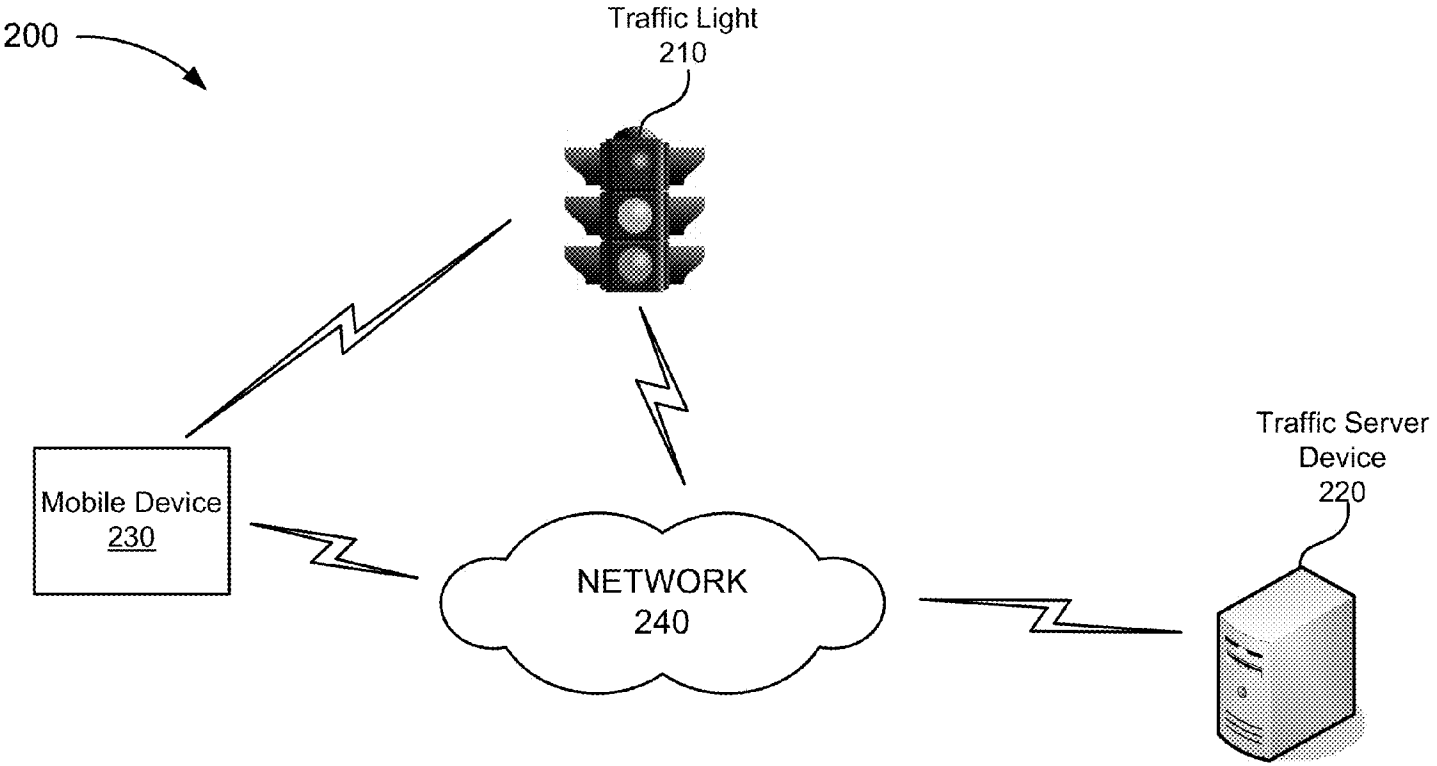
FIG. 2 is a diagram of an environment in which systems and/or methods, described herein, may be implemented.

FIG. 2 is a diagram of an environment 200 in which systems and/or methods described herein may be implemented. As shown in FIG. 2, environment 200 may include traffic light 210, traffic server device 220, and mobile device 230 interconnected by network 240. Devices of environment 200 may interconnect via wired connections, wireless connections, or a combination of wired and wireless connections.

Traffic light 210 may include one or more devices used to control a flow of vehicular and/or pedestrian traffic through an intersection. Traffic light 210 may include one or more colored lenses (e.g., a red lens, a green lens, and an amber lens). Traffic light 210 may obtain traffic pattern data and use the traffic pattern data to control the flow of traffic by causing the colored lenses to be selectively illuminated. Traffic light 210 may communicate traffic pattern information to traffic server device 220 and/or mobile device 230 via network 240.

Traffic server device 220 may include one or server devices that receives, processes, and provides information in a manner described herein. Traffic server device 220 may receive travel information from mobile device 230 and traffic pattern information from traffic light 210. Traffic server device 220 may use the travel information and the traffic pattern information to generate traffic flow data for mobile device 230 and/or traffic pattern information for modifying a traffic pattern of traffic light 210. Traffic server device 220 may provide the generated traffic flow data to mobile device 230 and/or the traffic pattern information to traffic light 210.

Mobile device 230 may include one or more devices capable of providing and receiving travel related information. Mobile device 230 may also include one or more devices capable of communicating (e.g., transmitting and/or receiving voice, text, images, and/or multimedia data) with traffic server device 220 and/or traffic light 210 via network 240. For example, mobile device 230 may include a handheld device, such as a cellular telephone, a personal digital assistant (PDA), etc.; a laptop, navigation system, etc.

Network 240 may include a local area network (LAN), a wide area network (WAN), a metropolitan area network (MAN), a mesh network, an intranet, the Internet, a cellular network, an optical fiber (or fiber optic)-based network, a satellite network, or a combination of networks. In some implementations, network 240 may employ one or more wireless communication protocols for a wireless personal area network (WPAN) and/or a wireless local area network (WLAN), such as, for example, IEEE 802.15 (e.g., Bluetooth) and IEEE 802.11 (e.g., Wi-Fi).

Although FIG. 2 shows example components of environment 200, in other implementations, environment 200 may include fewer components, different components, differently arranged components, or additional components than those depicted in FIG. 2. In some implementations, one or more components of environment 200 may perform one or more other tasks described as being performed by one or more other components of environment 200.

Figure 3:
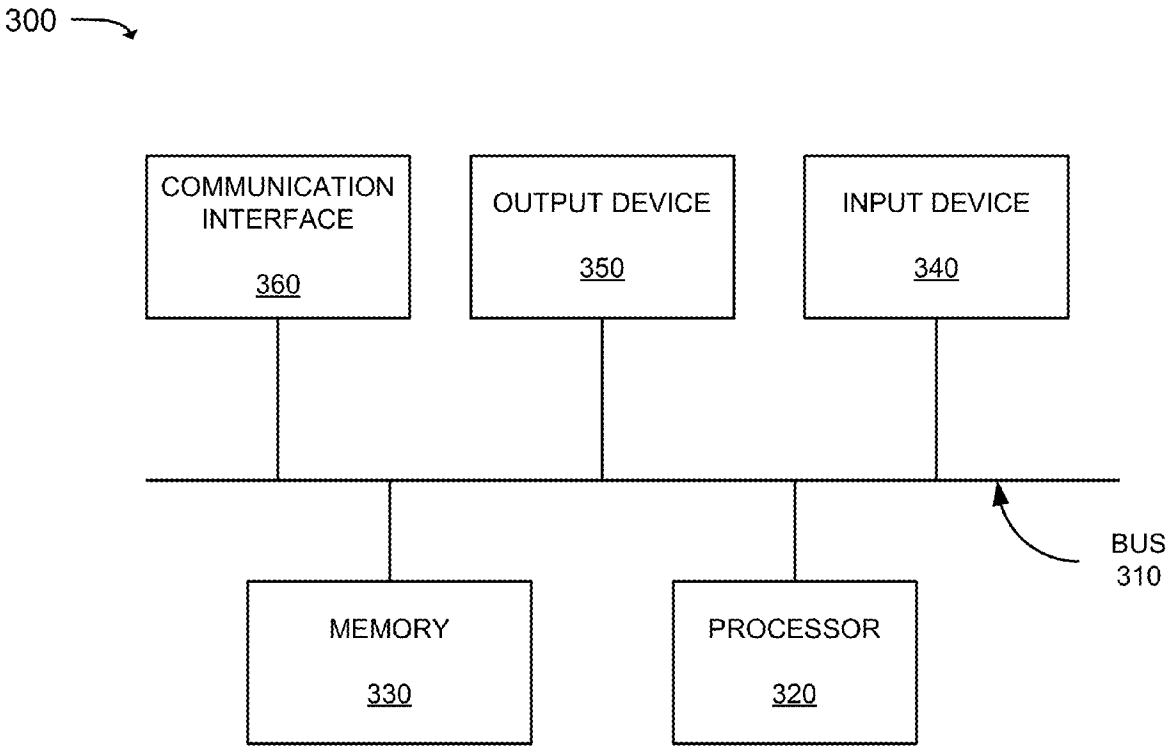
FIG. 3 illustrates example components of a device that may be used within the environment of FIG. 2 according to one or more implementations described herein.

FIG. 3 illustrates example components of a device 300 that may be used within environment 200. Device 300 may correspond to traffic light 210, traffic server device 220, and/or mobile device 230. In some implementations, traffic light 210, traffic server device 220, and/or mobile device 230 may include one or more devices 300 and/or one or more components of device 300.

As shown in FIG. 3, device 300 may include bus 310, processor 320, memory 330, input device 340, output device 350, and communication interface 360. Bus 310 may include a path that permits communication among the components of device 300. Processor 320 may include a processor, a microprocessor, an application specific integrated circuit (ASIC), a field programmable gate array (FPGA), or another type of processor that interprets and executes instructions. Memory 330 may include a random access memory (RAM) or another type of dynamic storage device that stores information or instructions for execution by processor 320, a read-only memory (ROM) or another type of static storage device that stores static information or instructions for processor 320, and/or a magnetic storage medium, such as a hard disk drive, or a removable memory, such as a flash memory.

Input device 340 may include a mechanism that permits an operator to input information to device 300, such as a control button, a keyboard, a keypad, a touch screen interface, a microphone, a camera, a video recorder, or another type of input device. Output device 350 may include a mechanism that outputs information to the operator, such as a light emitting diode (LED), a display, a speaker, or another type of output device. Communication interface 360 may include any transceiver-like mechanism that enables device 300 to communicate with other devices or networks. In one implementation, communication interface 360 may include a wireless interface, a wired interface, or a combination of a wireless interface and a wired interface.

Device 300 may perform certain operations, as described in detail below. Device 300 may perform these operations in response to processor 320 executing software instructions contained in a computer-readable medium, such as memory 330. A computer-readable medium may be defined as a non-transitory memory device. A memory device may include space within a single physical memory device or spread across multiple physical memory devices.

The software instructions may be read into memory 330 from another computer-readable medium or from another device via communication interface 360. The software instructions contained in memory 330 may cause processor 320 to perform processes described herein. Alternatively, hardwired circuitry may be used in place of or in combination with software instructions to implement processes described herein. Thus, implementations described herein are not limited to any specific combination of hardware circuitry and software.

Although FIG. 3 shows example components of device 300, in other implementations, device 300 may include fewer components, different components, differently arranged components, or additional components than depicted in FIG. 3. In some implementations, one or more components of device 300 may perform one or more tasks described as being performed by one or more other components of device 300.

Figure 4:
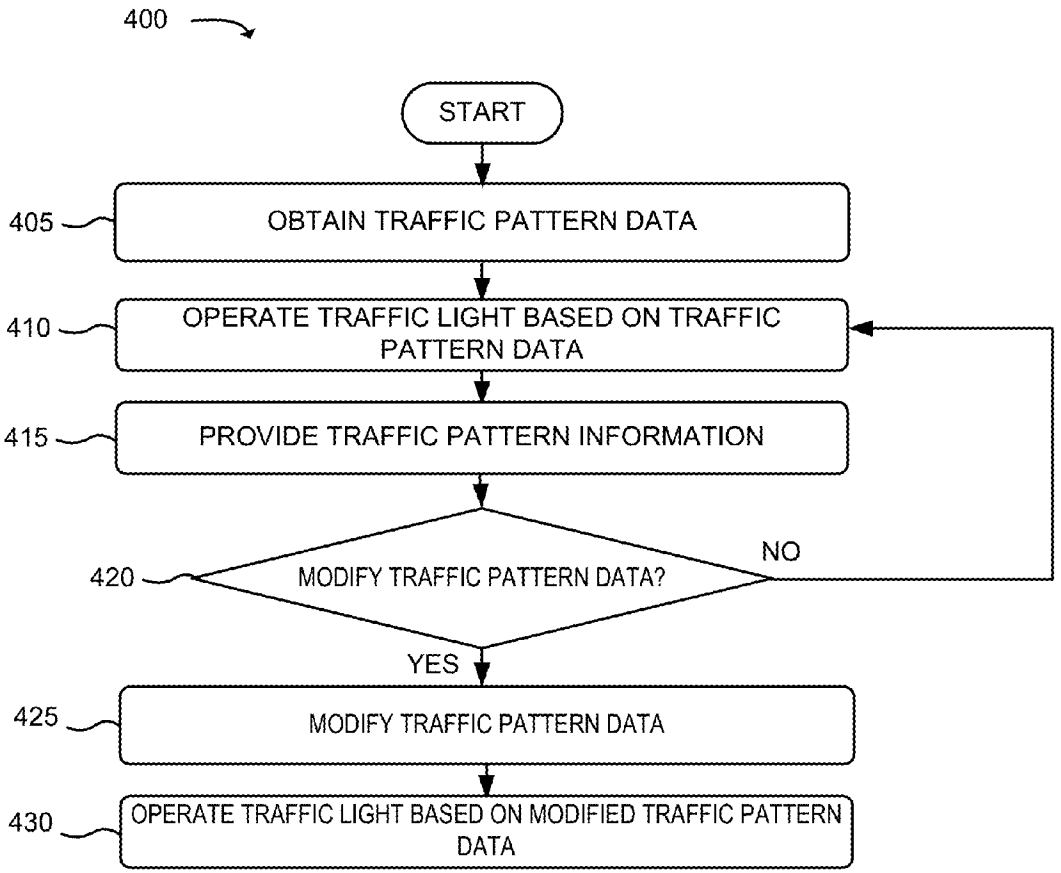
FIG. 4 is a flow chart of an exemplary process for operating a traffic light.

FIG. 4 is a flow chart of an example process 400 for operating traffic light 210. In some implementations, process 400 may be performed by traffic light 210. In other implementations, one or more blocks of process 400 may be performed by one or more devices instead of, or possibly in conjunction with, traffic light 210.

As shown in FIG. 4, process 400 may include obtaining traffic pattern data (block 405). For example, traffic light 210 may obtain traffic pattern data that is used to control a status of traffic light 210. In some implementations, traffic light 210 may receive traffic pattern data from another device (e.g., a device associated with a local transit authority or other agency responsible for controlling traffic within a particular region or area and/or traffic server device 220) via a network (e.g., network 240). In some implementations, traffic light 210 may obtain traffic pattern data that is stored in a memory that is internal (e.g., memory 330) or external to traffic light 210.

Process 400 may include operating the traffic light based on the traffic pattern data (block 410). For example, traffic light 210 may use the obtained traffic pattern data to control a flow of vehicle and/or pedestrian traffic through an intersection. In some implementations, the traffic pattern data may include information for determining a pattern or algorithm that can be used to determine an order and a period of time for causing a colored lens to be selectively illuminated. For example, traffic light 210 may use information included in the traffic pattern data to determine an order and a period of time for consecutively illuminating a green lens, an amber lens, and a red lens.

In some implementations, traffic light 210 may coordinate the illumination of different colored lens with one or more other traffic lights controlling different flows of traffic traveling through the same intersection as traffic light 210. In other implementations, traffic light 210 may include two or more sets of colored lenses and coordinate the illumination of lens included in the sets of colored lenses to control the different flows of traffic. In some implementations, traffic light 210 may coordinate the illumination of different colored lens using a timer or clock. The timer or clock may be internal or external to traffic light 210. In some implementations, traffic light 210 may control the period of time based on a master timer or master clock. For example, traffic light 210 may receive information regarding the master clock or master timer (e.g., via network 240) and may control an internal clock or timer used to operate traffic light 210 based on the received information.

Process 400 may include providing traffic pattern information (block 415). For example, traffic light 210 may provide traffic pattern information to one or more other devices of environment 200 (e.g., traffic server device 220 and/or mobile device 230). The traffic pattern information provided by traffic light 210 may include one or more portions of traffic pattern data. For example, the traffic pattern information may include an identifier or other information identifying the pattern or algorithm being used to determine the order and period of time for illuminating the colored lenses, information identifying a current status of traffic light 210 (e.g., information identifying which colored lens is currently being illuminated), and/or information regarding the clock or timer being used to operate traffic light 210 (e.g., an indication of when the current status of traffic light 210 will change, an indication of what the status of traffic light 210 will be at some future time, etc.).

Traffic light 210 may provide the traffic pattern information periodically, in response to a request, and/or upon determining an occurrence of a particular event. In some implementations, traffic light 210 may determine whether to provide traffic pattern information periodically, in response to a request, and/or upon determining an occurrence of a particular event based on information included in the traffic pattern data currently being used for operating traffic light 210. For example, traffic light 210 may receive traffic pattern data from a local transit authority. Traffic light 210 may determine to send traffic pattern information to traffic server device 220 at particular intervals or at a particular time of day based on information included in the traffic pattern data.

In some implementations, traffic light 210 may receive a request for traffic pattern information and provide one or more portions of traffic pattern data based on the request. For example, traffic light 210 may receive a request for traffic pattern information from traffic server device 220. Traffic light 210 may determine to provide traffic server device 220 information regarding particular portions of traffic pattern data based on the request.

In some implementations, the request may identify particular portions of traffic pattern information to be provided to particular devices. For example, in some implementations, traffic light 210 may receive a request from traffic server device 220. Traffic light 210 may determine to send information regarding a current status of traffic light 210 to traffic server device 220, mobile device 230, and/or another traffic light 210 based on the request. In some implementations, traffic light 210 may determine to send different portions of traffic pattern information to different devices.

Process 400 may include determining whether the traffic pattern data should be modified (block 420). For example, traffic light 210 may determine whether to modify the traffic pattern data periodically and/or in response to an occurrence of a particular event. In those situations where the traffic pattern data is not to be modified (block 420—NO), process 400 may return to block 410 with traffic light 210 continuing to operation based on the unmodified traffic pattern data.

On the other hand, in those situations where the traffic pattern data is to be modified (block 420—YES), process 400 may included modifying the traffic pattern data (block 425) and operating the traffic light based on the modified traffic pattern data (block 430). For example, in some implementations, traffic light 210 may determine to modify the traffic pattern data based on information received from traffic server device 220 and/or mobile device 230 and/or in response to determining an occurrence of a particular event. In some implementations, traffic light 210 may determine to modify its traffic pattern data based on receiving traffic pattern information from traffic server device 220 and/or mobile device 230. For example, traffic light 210 may receive traffic pattern information from traffic server device 220. Traffic light 210 may compare the current traffic pattern data to the traffic pattern information received from traffic server device 220. In those situations where the current traffic pattern data does not match the received traffic pattern information, traffic light 210 may determine that the traffic pattern data is to be modified.

In some implementations, traffic light 210 may determine to modify the traffic pattern data based on an occurrence of a particular event. For example, traffic light 210 may determine to modify the traffic pattern data based on determining that a particular vehicle and/or a particular type of vehicle (e.g., an emergency vehicle) is included in a flow of traffic controlled by traffic light 210. Traffic light 210 may determine the occurrence of the particular event based on information received from another device (e.g., another traffic light 210, traffic server device 220, and/or mobile device 230).

In some implementations, traffic light 210 may collect information associated with the flow of traffic being controlled by traffic light 210 and process the collected information to determine the occurrence of the particular event. For example, traffic light 210 may capture data that includes sound, images, and/or video recordings, and determine the occurrence of the particular event based on the captured data.

In response to determining to modify the traffic pattern data, traffic light 210 may modify the traffic pattern data and store the traffic pattern data in a memory (e.g., memory 330). Traffic light 210 may determine when to start using the modified traffic pattern. In some implementations, traffic light 210 may determine when to start using the modified traffic pattern data based on information included in the traffic pattern information received from traffic server device 220. For example, the traffic pattern information received from traffic server device 220 may include information identifying a future time and/or a particular event. Traffic light 210 may start using the modified traffic pattern data at the future time or upon the occurrence of the particular event.

As one example, traffic pattern information received from traffic server device 220 may include information indicating that between the hours of 8:00 am and 6:00 pm, traffic light 210 is to use the modified traffic pattern data when the flow of traffic controlled by traffic light 210 includes a bus or other high occupancy vehicle. Traffic light 210 may determine that a current time is between the hours of 8:00 am and 6:00 pm and begin using the modified traffic pattern data.

While FIG. 4 shows process 400 as including a particular quantity and arrangement of blocks, in some implementations, process 400 may include fewer blocks, additional blocks, or a different arrangement of blocks. Additionally, or alternatively, some of the blocks may be performed in parallel.

Figure 5:
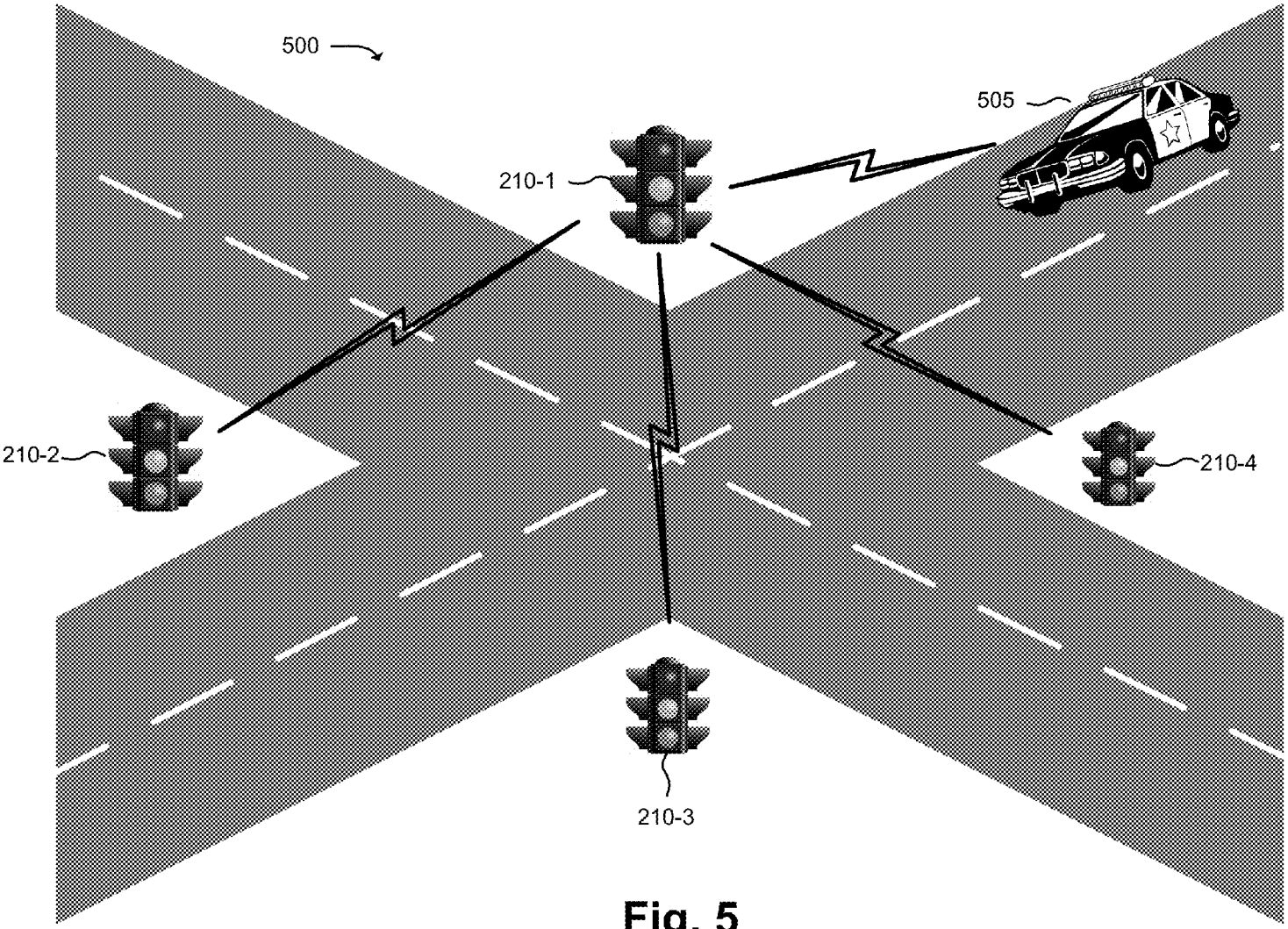
FIG. 5 is a diagram illustrating an example of the process described with respect to FIG. 4.

FIG. 5 illustrates an example of the process described above with respect to FIG. 4. As shown in FIG. 5, traffic lights 210-1-210-4 may be positioned to control traffic traveling through intersection 500. Based on initial traffic pattern data, traffic light 210-1 may determine to modify its traffic pattern data upon the occurrence of a particular event. During operation, traffic light 210-1 may determine that vehicle 505 is included in a flow of traffic controlled by traffic light 210-1. Traffic light 210 may determine that vehicle 505 is an emergency vehicle and that an emergency vehicle approaching intersection 500 corresponds to an occurrence of a particular event. Traffic light 210 may determine to modify the initial traffic pattern data based on determining that the particular event has occurred (e.g., that vehicle 505 is approaching intersection 500).

Traffic light 210 may modify the traffic pattern data to cause a particular colored lens (e.g., a green colored lens) to be illuminated at a particular time to enable vehicle 505 to proceed through intersection 500 without stopping. In response to determining to modify its traffic pattern data, traffic light 210-1 may also operate as a master traffic light for intersection 500 and may cause traffic lights 210-2-210-4 to modify their traffic pattern data to coordinate the flow of traffic traveling through intersection 500.

Traffic light 210-1 may transmit traffic pattern information to traffic lights 210-2-210-4. Traffic lights 210-2-210-4 may modify their initial traffic pattern data based on the received traffic pattern information. Based on the modified traffic pattern data, traffic lights 210-2-210-4 may cause red colored lenses to be illuminated at the time traffic light 210-1 is causing its green colored lenses to be illuminated to allow vehicle 505 to travel unimpeded through intersection 500.

Traffic light 210-1 may determine that vehicle 505 has traveled through intersection 500. For example, traffic light 210 may determine that an emergency vehicle having traveled through intersection 500 is an occurrence of a particular event. Traffic light 210 may determine to modify its modified traffic pattern data (e.g., revert back to its initial traffic pattern data) based on determining the occurrence of the particular event (e.g., an emergency vehicle having traveled through intersection 500). Traffic light 210-1 may cause traffic lights 210-2-210-4 to modify their modified traffic pattern data (e.g., revert back to their initial traffic pattern data) to coordinate the flow of traffic traveling through intersection 500 in a manner similar to that described above.

Figure 6:
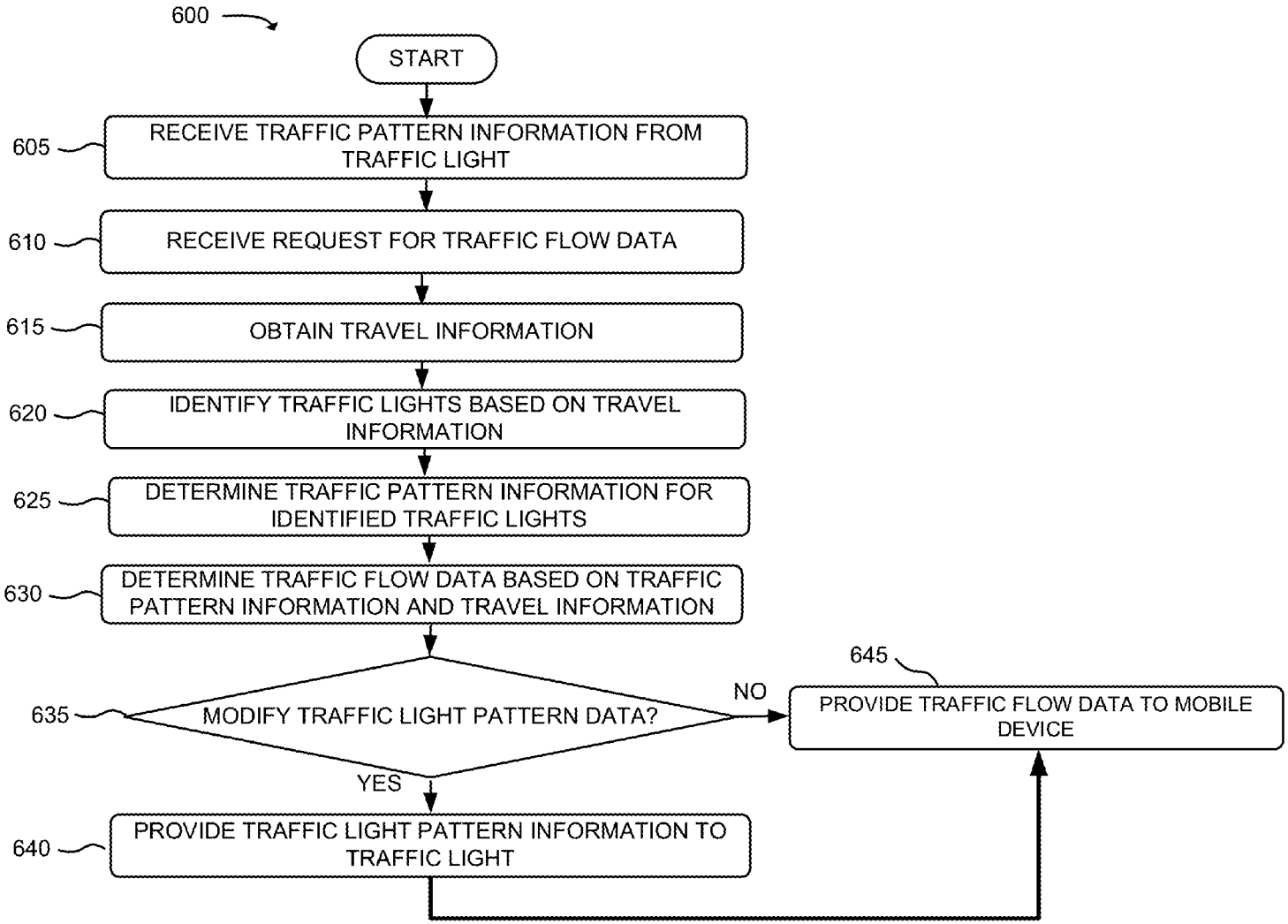
FIG. 6 is a flow chart of an exemplary process for providing traffic flow data.

FIG. 6 is a flow chart of an example process 600 for providing traffic flow data. In some implementations, process 600 may be performed by traffic server device 220. In some implementations, one or more blocks of process 600 may be performed by one or more devices instead of, or possibly in conjunction with, traffic server 220.

As shown in FIG. 6, process 600 may begin with obtaining traffic pattern information (block 605). For example, traffic server device 220 may obtain traffic pattern information from traffic light 210. In some implementations, traffic server device 220 may send a request to traffic light 210 and receive traffic pattern information from traffic light 210 based on the request. In some implementations, traffic server device 220 may periodically receive traffic pattern information from traffic light 210. In some implementations, traffic server device 220 may receive traffic pattern information from a device other than traffic light 210 (e.g., a server associated with a local transit authority or particular service provider). In any event, traffic server device 220 store the received traffic pattern information in a memory associated with traffic server device 220 (e.g., memory 330).

Process 600 may include receiving a request for traffic flow data (block 610). For example, traffic server device 220 may receive a request for traffic flow data from mobile device 230. In some implementations, traffic server device 220 may identify and/or authenticate mobile device 230 in response to receiving the request. For example, traffic server device 220 may identify a user of mobile device 230 based on an identifier (e.g., a user identifier, a password, a device identifier, an access code, biometric data (e.g., voice signal), etc.). In some implementations, the identifier may be included in the request. In some implementations, upon receiving the request, traffic server device 220 may request that the identifier and/or other identifying information be provided.

Based on the identifier, traffic server device 220 may determine whether the user/mobile device 230 has previously registered for and/or subscribed with, for example, a particular service provider and/or is authorized to receive traffic flow data. For example, traffic server device 220 may receive the identifier and may compare the identifier to information previously associated with the user/mobile device 230. If the user/mobile device 230 is not properly identified/authenticated, the request may be denied. Alternatively or additionally, if the user/mobile device 230 is not properly identified/authenticated, traffic server device 220 may require mobile device 230 to register/subscribe with a particular service and/or service provider associated with traffic server device 220 to enable mobile device 230 to receive traffic flow data.

Process 600 may include obtaining travel information (block 615). For example, traffic server device 220 may obtain travel information from mobile device 230. The travel information may include information associated with mobile device 230 traveling from one location to another. For example, travel information may include location information, route information, and/or vehicle information. Location information may include information identifying a current location of mobile device 230. Route information may include information identifying a destination of mobile device 230 and a particular route that is to be traveled to arrive at the destination. Vehicle information may include information identifying a speed of a vehicle associated with mobile device 230, a particular type of the vehicle (e.g., emergency vehicle, public transportation vehicle, passenger vehicle, etc.), and/or information identifying a user of mobile device 230 as a particular type of user (e.g., first responder, dignitary, elected official, etc.).

In some implementations, traffic server device 220 may obtain travel information in response to identifying/authenticating the user/mobile device 230. In some implementations, traffic server device 220 may receive travel information prior to identifying/authenticating the user/mobile device 230. For example, traffic server device 220 may receive travel information from mobile device 230 prior to, or in conjunction with, receiving the request for traffic flow data. In this latter situation, the request may include one or more portions of travel information associated with the mobile device 230 and traffic server device 220 may extract the travel information from the request. Additionally or alternatively, traffic server device 220 may determine one or more portions of travel information based on stored information associated with mobile device 230. For example, traffic server device 220 may determine one or more portions of travel data based on user preference information and/or historical information (e.g., past travel information received from mobile device 230).

Process 600 may include identifying traffic lights based on the travel information (block 620) and determining traffic pattern information for the identified traffic lights (block 625). For example, traffic server device 220 may identify one or more traffic lights based on travel information received from mobile device 230 and determine traffic pattern information for the identified traffic lights. As one example, traffic server device 220 may determine a current location and a route of travel of mobile device 230 based on the travel information. Traffic server device 220 may identify one or more traffic lights 210 that are positioned near the current location and/or located along the determined route of travel and obtain traffic pattern information associated with the identified traffic lights 210.

In some implementations, traffic server device 220 may identify one or more traffic lights that are positioned near the current location of mobile device 230 and/or located along the determined route of travel based on traffic pattern information stored in a memory (e.g., memory 330). For example, traffic server device 220 may determine location information associated with a plurality of traffic lights that transmit traffic pattern data to traffic server device 220. Traffic server device 220 may use the location information to identify one or more traffic lights that are positioned near the current location of mobile device 230 and/or located along the determined route of travel. Traffic server device 220 may obtain stored traffic pattern information associated with the identified traffic lights 210 and/or request new or updated traffic pattern information from the identified traffic lights 210.

In some implementations, traffic server device 220 may identify one or more traffic lights 230 based on other information associated with mobile device 230. For example, traffic server device 220 may access stored information (e.g., user profile, preference data, default data, information identifying a default or last known location, etc.) associated with the user/mobile device 230. The stored information may include information identifying a default location for mobile device 230. Traffic server device 220 may identifying a traffic light 210 associated with the default location and may determine to obtain traffic pattern information from the identified traffic light 210.

Process 600 may include determining traffic flow data (block 630). For example, traffic server device 220 may determine traffic flow data based on traffic pattern information determined for the identified traffic lights and travel information received from mobile device 230. The traffic flow data may include information identifying a current status of one or more of the identified traffic lights, a projected status of one or more of the identified traffic lights, information for modifying one or more portions of travel data, and/or information for modifying one or more portions of traffic pattern information determined for the identified traffic lights.

In some implementations, traffic server device 220 may determine an amount of time until mobile device 230 will reach the identified traffic lights and a projected status of the traffic lights based on the travel information and the traffic pattern information for the identified traffic lights. Based on the projected status of the traffic lights, traffic server device 220 may determine information for modifying one or more portions of travel information associated with mobile device 230. For example, traffic server device 220 may determine that a projected status for one of the traffic lights is red. Traffic server device 220 may determine information for modifying the speed of the vehicle so that the status of the traffic light will be green as mobile device 230 travels through an intersection controlled by the traffic light.

In some implementations, traffic server device 220 may determine an amount, level, and/or type of traffic flow data to be provided to mobile device 230. For example, during registration, a user profile associated with the user/mobile device 230 may be created. Traffic server device 220 may access the user profile based on the identifier or other information included in the request for traffic flow data and/or travel information. Traffic server device 220 may determine the amount, level, and/or type of traffic flow data to be provided to mobile device 230 based on information included in the user profile.

For example, certain types, portions, or amounts of traffic flow data may be provided based on a level of service subscribed to by a user of mobile device 230. For example, different levels of service may enable a user to receive information regarding different ones of traffic flow data related to traffic lights 210, traffic flow data related to mobile devices associated with friends and/or family members, traffic flow data related to mobile devices associated with a particular company or service provider (e.g., a current location of a public transportation vehicle or delivery vehicle), traffic flow data related to mobile devices located near a current location of mobile device 230, a frequency at which traffic flow data may be provided (e.g., more or less often relative to other levels of service), etc.

Process 600 may include determining whether the traffic pattern data should be modified (block 635). For example, traffic server device 220 may determine whether to modify traffic pattern data for one or more traffic lights 210 based on traffic flow data and/or travel information associated with mobile device 230. In some implementations, traffic server device 220 may determine whether to modify traffic pattern data based on a level of service subscribed to by the user/mobile device 230. Additionally or alternatively, traffic server device 220 may determine whether to modify traffic pattern data for one or more traffic lights 210 based on a type of vehicle associated with mobile device 230. For example, traffic server device 220 may determine to modify traffic pattern data when mobile device 230 is associated with an emergency response vehicle, such as an ambulance, fire truck, or police car.

If traffic light pattern data is to be modified (block 635—YES), process 600 may include providing traffic pattern information (block 640). For example, traffic server device 220 may provide traffic pattern information to traffic light 210 to cause traffic light 210 to modify its traffic pattern data. The provided traffic pattern information may include one or more portions of travel information obtained from mobile device 230 and/or other information that enables traffic light 210 to modify its traffic pattern data to cause a particular colored lens to be illuminated at a particular time. For example, in some implementations, traffic server device 220 may send traffic pattern information to traffic light 210 to enable traffic light 210 to modify its traffic pattern data to cause a green colored lens to be illuminated as a vehicle associated with mobile device 230 approaches and/or travels through an intersection controlled by traffic light 210. In other implementations, traffic server device 220 may send traffic pattern information that instructs traffic light 210 to determine when a vehicle associated with mobile device 230 is approaching and to change to a particular status upon detection. Thereafter, traffic light 210 may determine that mobile device 230 is approaching an intersection controlled by traffic light 210 and modify its traffic pattern data in a manner similar to that described above with respect to block 425.

If the traffic pattern data is not to be modified (block 635—NO) or following (or in conjunction with) providing traffic pattern information to traffic light 210 (block 640), process 600 may include providing traffic flow data (block 645). For example, traffic server device 220 may provide traffic flow data to mobile device 230. In some implementations, the traffic flow data may include information for a causing a graphical user interface to be displayed by mobile device 230. For example, the traffic flow data may include information for causing a graphical user interface to be displayed in conjunction with map data being displayed by a navigation system being used by a user of mobile device 230. In some implementations, the traffic flow data may provide real-time (or near real-time) data to be displayed by a graphical user interface. For example, the traffic flow data may provide data for displaying a current status and location of traffic light 210.

While FIG. 6 shows process 600 as including a particular quantity and arrangement of blocks, in some implementations, process 600 may include fewer blocks, additional blocks, or a different arrangement of blocks. Additionally, or alternatively, some of the blocks may be performed in parallel.

Figure 7:
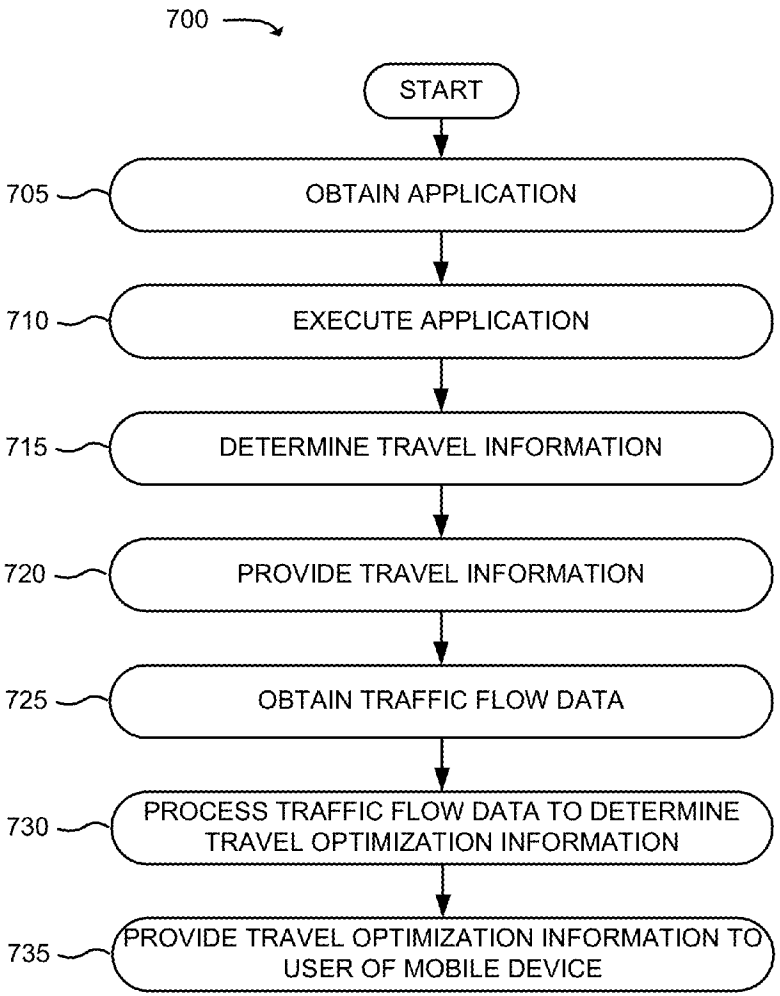
FIG. 7 is a flow chart of an exemplary process for providing travel information.

FIG. 7 is a flow chart of an example process 700 for providing travel information. In some implementations, process 700 may be performed by mobile device 230. In some implementations, one or more blocks of process 700 may be performed by one or more devices instead of, or possibly in conjunction with, mobile device 230.

As shown in FIG. 7, process 700 may include obtaining an application for providing travel optimization data (block 705) and executing the application (block 710). For example, mobile device 230 may obtain the application by downloading the application via a network and/or accessing a memory (e.g., memory 330) of mobile device 230. In some implementations, a user of mobile device 230 may subscribe to a service provided by a service provider. Upon successful registration with the service provider, the application, or information that enables mobile device 230 to access/obtain the application, may be provided to the user and/or mobile device 230. For example, upon successful registration, the user may be provided with a key or access code that enables the user to download and/or access the application.

After obtaining the application, mobile device 230 may receive an input (e.g., via input device 340) entered by the user. Mobile device 230 may execute the application based on the received input. Additionally or alternatively, mobile device 230 may automatically execute the application based on an occurrence of a particular event or one or more predetermined criteria that may be specified by the user and/or service provider. In some implementations, mobile device 230 may communicate with one or more other devices (e.g., a satellite global positioning system) to collect information about a location, direction, speed, time of day, and/or condition associated with mobile device 230. Based on the collected information, mobile device 230 may determine that a particular event has occurred and/or that one or more of the predetermined criteria has been met, and cause the execution of the application.

For example, mobile device may use information about the location of the user to determine whether the user/mobile device 230 is located outside or within a building and may automatically execute the application when the user is located outside. Mobile device 230 may use information about the speed of the user to determine whether the user is walking or traveling in a vehicle and may automatically execute the application when the user is traveling in a vehicle. Mobile device 230 may use information about the current time of day to determine whether the current time of day corresponds to a time of day that the user is typically traveling from one location to another and may automatically execute the application based on the user traveling from the one location to the other.

Process 700 may include determining travel information (block 715). For example, mobile device 230 may determine information regarding a current location, a current speed, a direction of travel, a destination, and/or route information of mobile device 230. Mobile device 230 may process one or more portions of the determined information to generate travel information. In some implementations, mobile device 230 may determine one or more portions of the travel information in conjunction with determining the one or more predetermined criteria for executing the application as described above with respect to block 710.

In some implementations, mobile device 230 may determine travel information based on historical information (e.g., previously determined travel information) stored in a memory of mobile device 230 (e.g., memory 330) or obtained via another device (e.g., traffic server device 220). For example, mobile device 230 may determine a current location and time of day. Mobile device 230 may access memory 330 to obtain historical information associated with the current location and/or time of day. Based on the obtained historical information, mobile device 230 may determine that the user intends to travel a particular route from one location (e.g., home/work) to another location (e.g., work/home). Mobile device 230 may determine one or more portions of travel information based on determining that the user intends to travel the particular route.

Process 700 may include providing travel information (block 720). For example, mobile device 230 may request traffic flow data from traffic server device 220, based on, for example, determining to execute the application. In response to the request, mobile device 230 may receive a message identifying one or more portions of travel information to be provided to traffic server device 220. Mobile device 230 may provide the identified travel information to traffic server device 220.

In some implementations, the travel information may include an identifier or other information that uniquely identifies the user and/or mobile device 230. The identifier or other information may have been provided when the user was subscribing to, or registering with, the service provider. The identifier or other information may allow traffic server device 220 to identify mobile device 230, determine that mobile device 230 is authorized to receive traffic flow data, and/or determine a type and/or amount of traffic flow data to provide to mobile device 230 as described above with respect to block 620.

Process 700 may include obtaining traffic flow data (block 725). For example, mobile device 230 may obtain traffic flow data from traffic server device 220 and/or traffic light 210 in response to mobile device 230 providing travel information. Additionally or alternatively, mobile device 230 may receive traffic flow data without first providing travel information to traffic server device 220.

For example, upon executing the application, mobile device 230 may automatically and/or periodically receive traffic flow data from traffic server device 220 and/or traffic light 210. In some implementations, mobile device 230 may automatically receive traffic flow data based on historical information associated with mobile device 230. For example, mobile device 230 may automatically and/or periodically receive traffic flow data relating to most recent location information stored in a memory associated with traffic server device 220. In some implementations, upon executing the application, mobile device 230 may automatically receive initial traffic flow data based on information (e.g., user preference information and/or information identifying a default location) that is included in a user profile associated with mobile device 230. Mobile device 230 may receive updated traffic flow data in response to transmitting travel information to traffic server device 220. Thereafter, mobile device 230 may receive additional updated traffic flow data. Mobile device 230 may receive the additional updated data periodically and/or in response to transmitting updated or additional travel information to traffic server device 220.

In some implementations, mobile device 230 may receive traffic pattern information from traffic server device 220 and/or traffic light 210. Mobile device 230 may process the travel information and traffic pattern information in a manner similar to that described above with respect to blocks 620-630. Mobile device 230 may determine traffic flow data alternatively or in addition to receiving traffic flow data from traffic server device 220. Additionally or alternatively, mobile device 230 may automatically receive traffic flow data based on traffic light 210 and/or traffic server device 220 determining that mobile device 230 is within a predetermined distance of traffic light 210 (e.g., as described above with respect to block 420).

Process 700 may include processing traffic flow data (block 730). For example, mobile device 230 may process traffic flow data received from traffic server device 220 to determine travel optimization data that enables the user to optimize travel time. The determined travel optimization data may include information identifying a current status of traffic light 210 and/or information identifying a projected status of traffic light 210. Additionally or alternatively, the determined travel optimization data may include suggested travel information that enables the optimize travel time.

In some implementations, the suggested travel information may be determined based on information for modifying one or more portions of travel information that is included in the traffic flow data. The suggested travel information may include, for example, information identifying a suggested speed for causing the user to arrive at a particular traffic light while the particular traffic light is causing a particular colored lens to be illuminated (e.g., a green lens).

Process 700 may include providing travel optimization data to a user (block 735). For example, mobile device 230 may provide travel optimization data included in or in conjunction with outputting one or more alerts. Mobile device 230 may output an audible alert (e.g., a tone or other sound output via a speaker), a visual alert (e.g., a pop-up notification, graphical icon, or other information output via a display), or a physical alert (e.g., a vibration or movement of mobile device 230). The travel optimization information and/or alerts may be output via a speaker or display associated with mobile device 230 (e.g., output device 350 and/or a device connected to mobile device 230 via one or more wired/wireless networks).

In some implementations, mobile device 230 may output the travel optimization data as an audible and/or visual alert that provides information regarding a suggested speed of travel to enable the user to adjust their speed of travel (e.g., speed up or slow down) and optimize the user's travel time (e.g., avoid stopping at a red light). In some implementations, mobile device 230 may output an audible and/or visual alert that notifies the user that travel optimization data is available. Additionally or alternatively, mobile device 230 may output the travel optimization data in response to receiving an input from a user.

In some implementations, mobile device 230 may periodically determine additional and/or updated travel information and/or obtain traffic flow data and determine updated travel optimization data. Mobile device 230 may provide the updated travel optimization data to the user via one or more alerts as the user is traveling toward the destination. The updated travel optimization data may include updated suggested travel information based on the additional and/or updated travel information and/or traffic flow data. The updated suggested travel information may include information that enables the user to further modify one or more portions of the travel information.

While FIG. 7 shows process 700 as including a particular quantity and arrangement of blocks, in some implementations, process 700 may include fewer blocks, additional blocks, or a different arrangement of blocks. Additionally, or alternatively, some of the blocks may be performed in parallel.

Figure 8A:
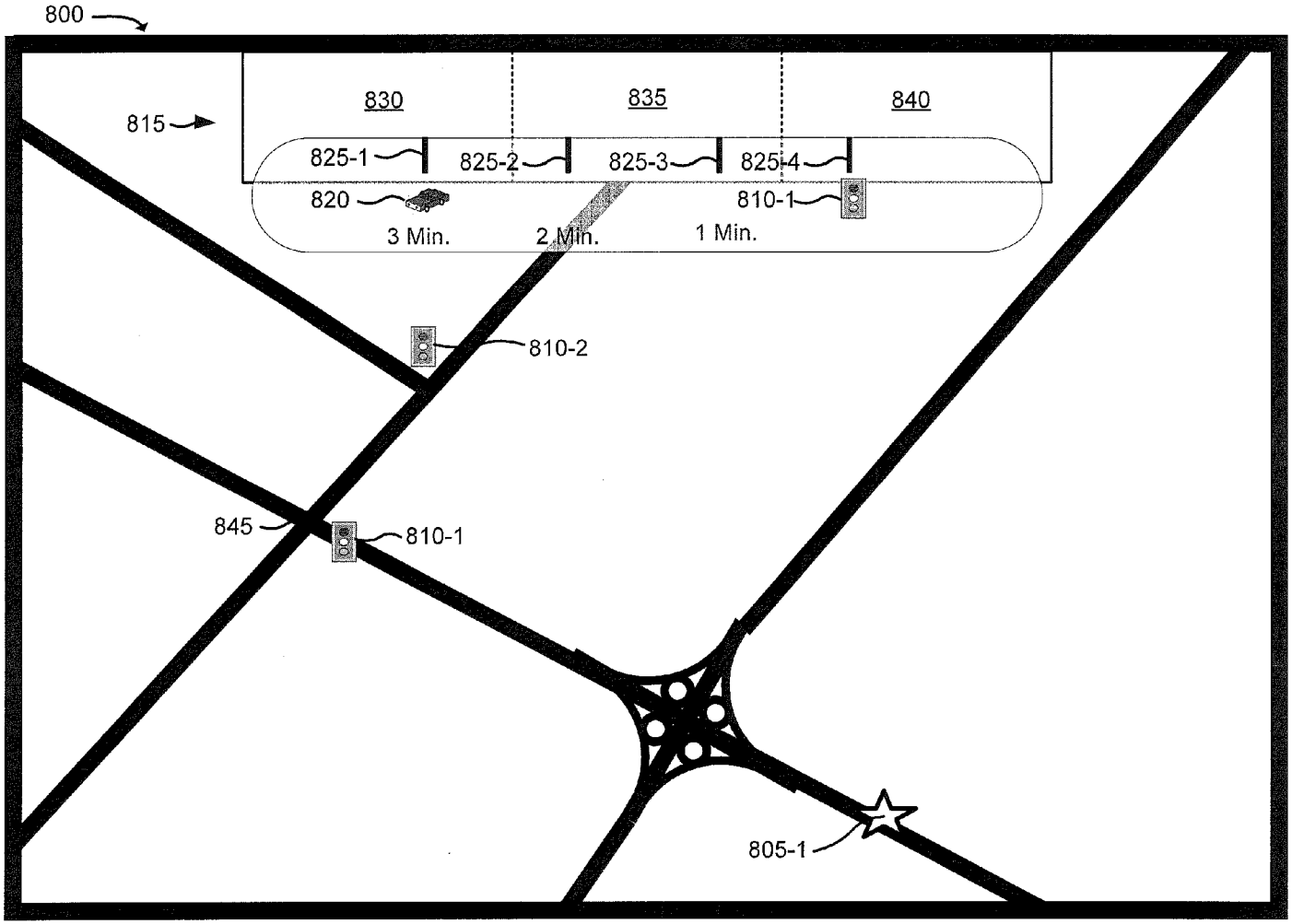
FIGS. 8A-8C and 9-11 are diagrams illustrating examples of the process described with respect to FIG. 7.
Figure 8B:
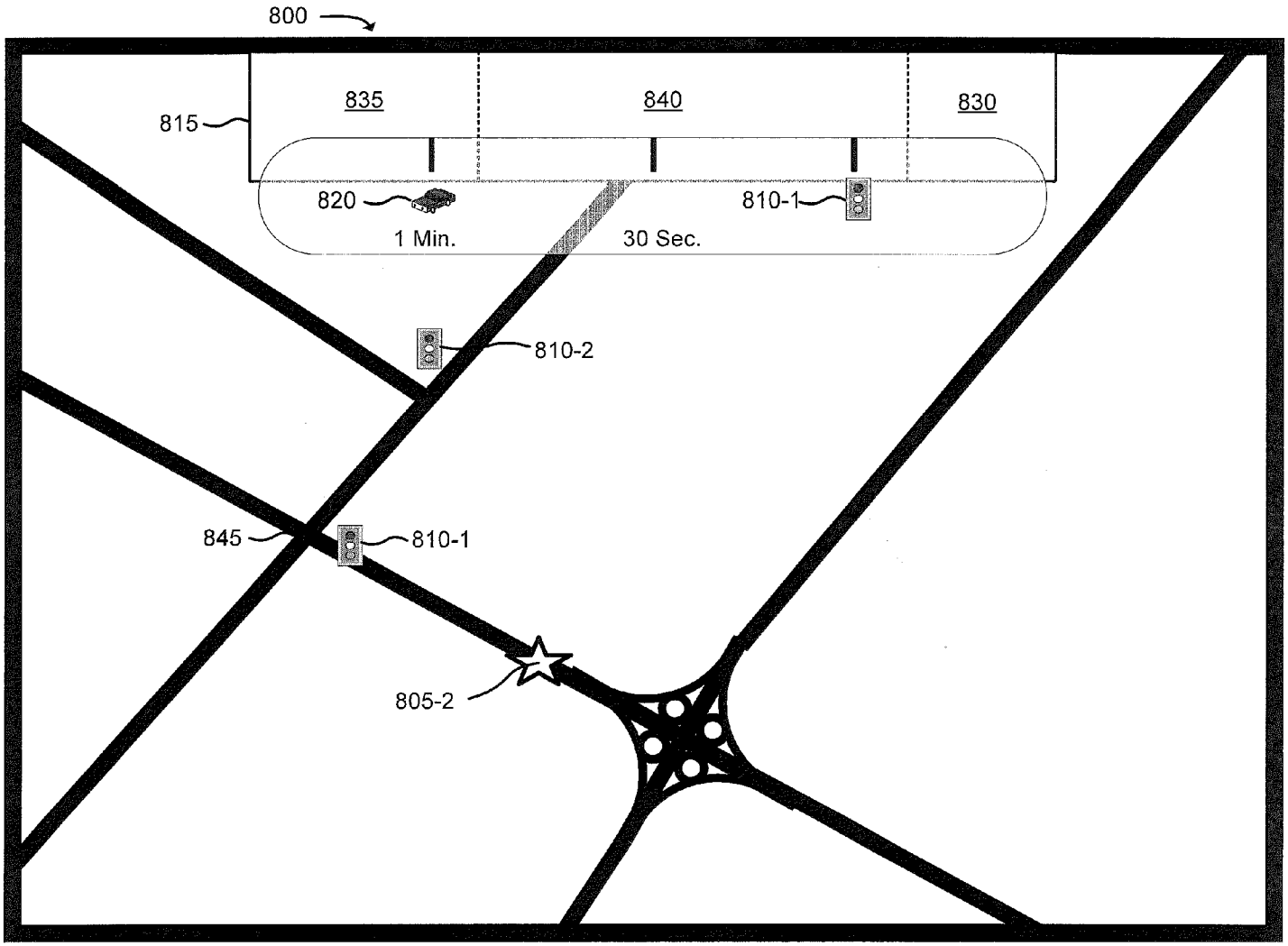
Figure 8C:
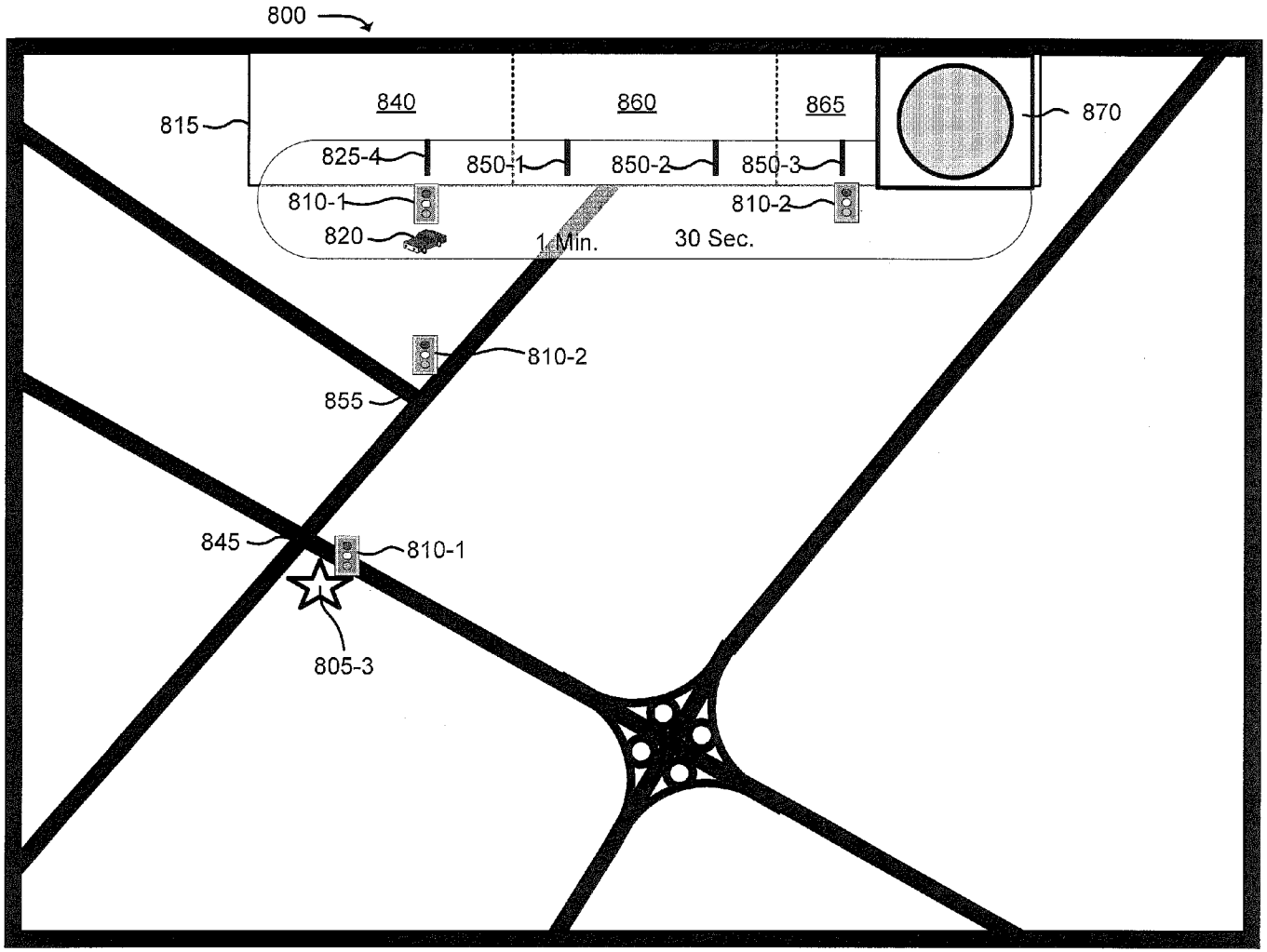

FIGS. 8A-8C are diagrams that illustrate an example 800 of the process described above with respect to FIG. 7. For example 800, assume that mobile device 230 obtains travel information and traffic flow data to determine travel optimization data as described above with respect to blocks 715-730. Mobile device 230 may output a visual alert that includes one or more portions of the determined travel information, traffic flow data, and/or travel optimization data being displayed in conjunction with map data via a display (e.g., output device 350). As shown in relation to FIG. 8A, mobile device 230 may cause current location icon 805-1, traffic light icons 810-1 and 810-2, and travel optimization data 815 to be displayed in conjunction with map data corresponding to a particular route of travel.

Current location icon 805-1 may represent the current location of the user/mobile device 230. Traffic light icons 810-1 and 810-2 may represent traffic lights that will be encountered along the particular route of travel. Travel optimization data 815 may provide information regarding a status of the next traffic light (e.g., the traffic light corresponding to traffic light icon 810-1) to be encountered along the particular route of travel. Travel optimization data 815 may include a user icon 820 positioned adjacent to time reference point 825-1. Time reference point 825-1 may be positioned over traffic light status indicator 830 to indicate a current status of the next traffic light (e.g., the traffic light 210 represented by traffic light icon 810-1). Traffic light status indicator 830 may be a block or other graphical icon that is colored to represent the color of the lens currently being illuminated by the next traffic light. Time reference points 825-2 and 825-3 may be positioned over traffic light indicator 835 to indicate a projected a status of the next traffic light as the user progresses along the particular route of travel. A final time reference point 825-4 may be positioned over a final traffic light icon 840. Final traffic light icon 840 may indicate a projected status of the next traffic light as the user arrives at intersection 845.

Time reference points 825-1-825-3 may be associated with information identifying amount of time it will take to travel to intersection 845 (e.g., the next traffic light). In some implementations, mobile device 230 will calculate the amount of time based on the travel information. In some implementations, traffic server device 220 may include information identifying the amount of time in traffic flow data provided to mobile device 230.

The amount of time may be divided into one or more time periods. A projected status of the next traffic light may be determined for each of the one or more time periods. As shown in FIG. 8A, the amount of time may be determined to be a total time of 3 minutes and divided into three time intervals that each represent a 1 minute time period. Time reference point 825-1 may be positioned to represent a start of a first time interval and may be annotated with information identifying the total amount of time (e.g., 3 minutes) to reach intersection 845 (e.g., the next traffic light). Time reference point 825-2 may be positioned to represent a start of a second time interval and may be annotated with information identifying a remaining portion of the total amount of time corresponding to a start of the second time interval (e.g., 2 minutes). Time reference point 825-3 may be positioned to represent a start of a third time interval and may be annotated with information identifying a remaining portion of the total amount of time corresponding to the start of the third time interval (e.g., 1 minute).

Final time reference point 825-4 may be positioned to represent an end of the total amount of time (i.e., arrival at intersection 845). A first traffic light device icon 810-1 may be positioned adjacent to final reference time point 825-4 to indicate that time reference point 825-4 represents a projected arrival at intersection 845. Additionally or alternatively, one or more portions of travel data 815 may be provided via an audible alert.

As the user/mobile device 230 progresses along the particular route of travel, mobile device 230 may determine updated travel information and/or obtain updated traffic flow data. Mobile device 230 may process the updated information to determine updated travel optimization data and output a visual alert by altering one or more portions of the displayed information. For example, as shown in FIG. 8B, based on the updated travel optimization data, mobile device 230 may modify a position of the current location icon, represented by current location icon 805-2, and travel data 815 to reflect the updated travel optimization information.

As shown in FIG. 8C, as the user/mobile device 230 reaches intersection 845, mobile device 230 may again determine updated travel optimization data and output a visual alert that includes information associated with a subsequent traffic light, represented by traffic light icon 810-2, and time reference points 850-1-850-3. Time reference points 850-1 and 850-2 may be positioned over status indicator 860 to indicate a projected status of the subsequent traffic light (e.g., the traffic light represented by traffic light icon 810-2). Status indicator 860 may be a block or other graphical icon that is colored to indicate a projected status of the subsequent traffic light (e.g., colored to indicate a color of the lens that will be illuminated) as the user progresses along the particular route of travel. A second traffic light icon 810-2 may be displayed in conjunction with time reference point 850-3 and status indicator 865. Status indicator 865 may be a block that is colored to indicate a projected status of the subsequent traffic light as the user/mobile device 230 arrives at intersection 855. Icon 860 may be displayed to prominently identify the current status of the next traffic light (e.g., the traffic light represented by traffic light icon 510-1).

Figure 9:
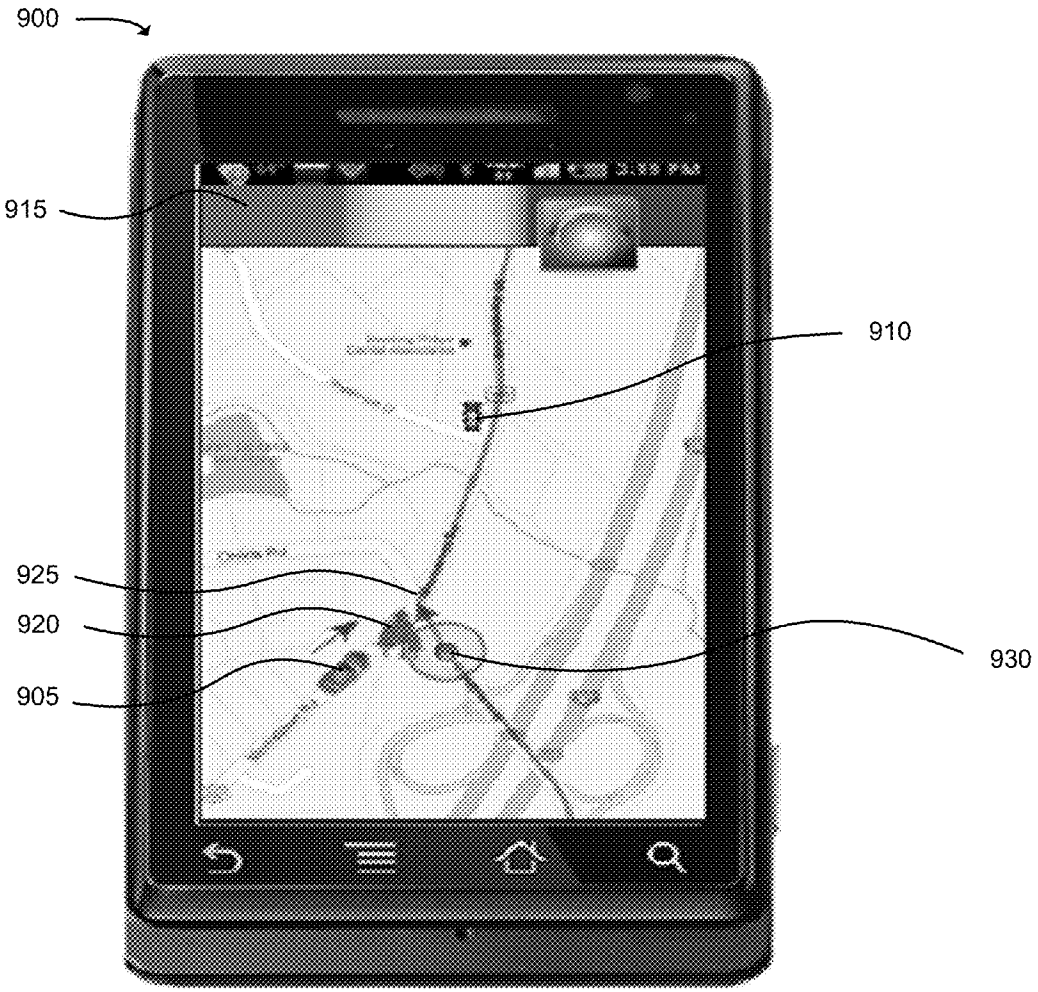

FIG. 9 is a diagram that illustrates another example 900 of the process described above with respect to FIG. 7. Assume, for example, that mobile device 230 uses travel information and traffic flow data to determine travel optimization data and outputs one or more visual and/or audible alerts as described above with respect to blocks 715-730. Based on the travel information and/or traffic flow data, mobile device 230 may determine that a current location of mobile device 230 (as shown by current location icon 905) is associated with an intersection that has an obscured line of site. Based on determining that the current location is associated with an intersection having an obscured line of site, mobile device 230 may obtain traffic flow data associated with other mobile devices having a current location in the vicinity of the intersection. Mobile device 230 may request and/or automatically receive the traffic flow data associated with the other devices from traffic server device 220 and/or traffic light 210 (e.g., the traffic light corresponding to traffic light icon 910).

As shown in FIG. 9, mobile device 230 may output a visual alert that includes current location icon 905, traffic light icon 910, and travel optimization information 915 displayed in conjunction with map data corresponding to a current location of mobile device 230. Additionally, the visual alert may include icon 920, corresponding to a tree located at intersection 925, to be displayed to indicate the obscured line of site to the user and vehicle icon 930 to notify the user of the presence of another vehicle that may not be visible to the user due to the obscured line of site.

Figure 10:
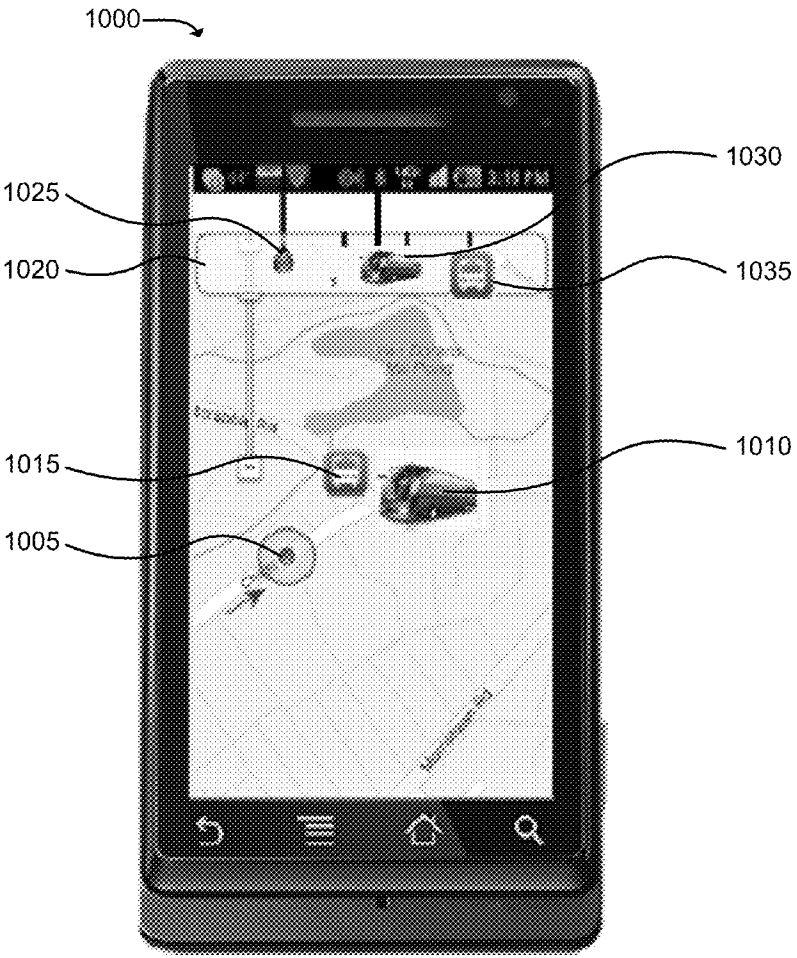

FIG. 10 is a diagram that illustrates another example 1000 of the process described above with respect to FIG. 7. For example 1000, assume that mobile device 230 uses travel information and traffic flow data to determine travel optimization data and outputs one or more visual and/or audible alerts as described above with respect to blocks 715-730. As shown in relation to FIG. 10, mobile device 230 may output a visual alert that includes current location icon 1005 representing a current location of the user, vehicle icon 1010 representing a current location of a bus, bus stop icon 1015 representing a destination of the user (e.g., a bus stop for catching the bus represented by vehicle icon 1010), and travel optimization data 1020 displayed in conjunction with corresponding map data. Travel optimization data 1020 may include icons 1025 and 1030 to indicate a projected arrival of the user at the bus stop relative to the bus.

The travel optimization data 1020 may allow the user to adjust their travel to the bus stop to reduce the time the user is waiting at the bus stop for the bus to arrive. For example, during periods of inclement weather, the user may use the travel optimization information to maximize the amount of time the user remains indoors prior to leaving for the bus stop. Additionally or alternatively, a driver of the bus may use the travel optimization information to maximize an amount of time spent waiting for additional riders at the bus stop. For example, mobile device 230 may output an alert indicating that an amount of time to be waited to avoid having to stop at a traffic light positioned along the route traveled by the bus. The driver may delay departing from the bus stop to use the time that otherwise would be spent stopped at the traffic light waiting for additional riders at the bus stop.

Figure 11:
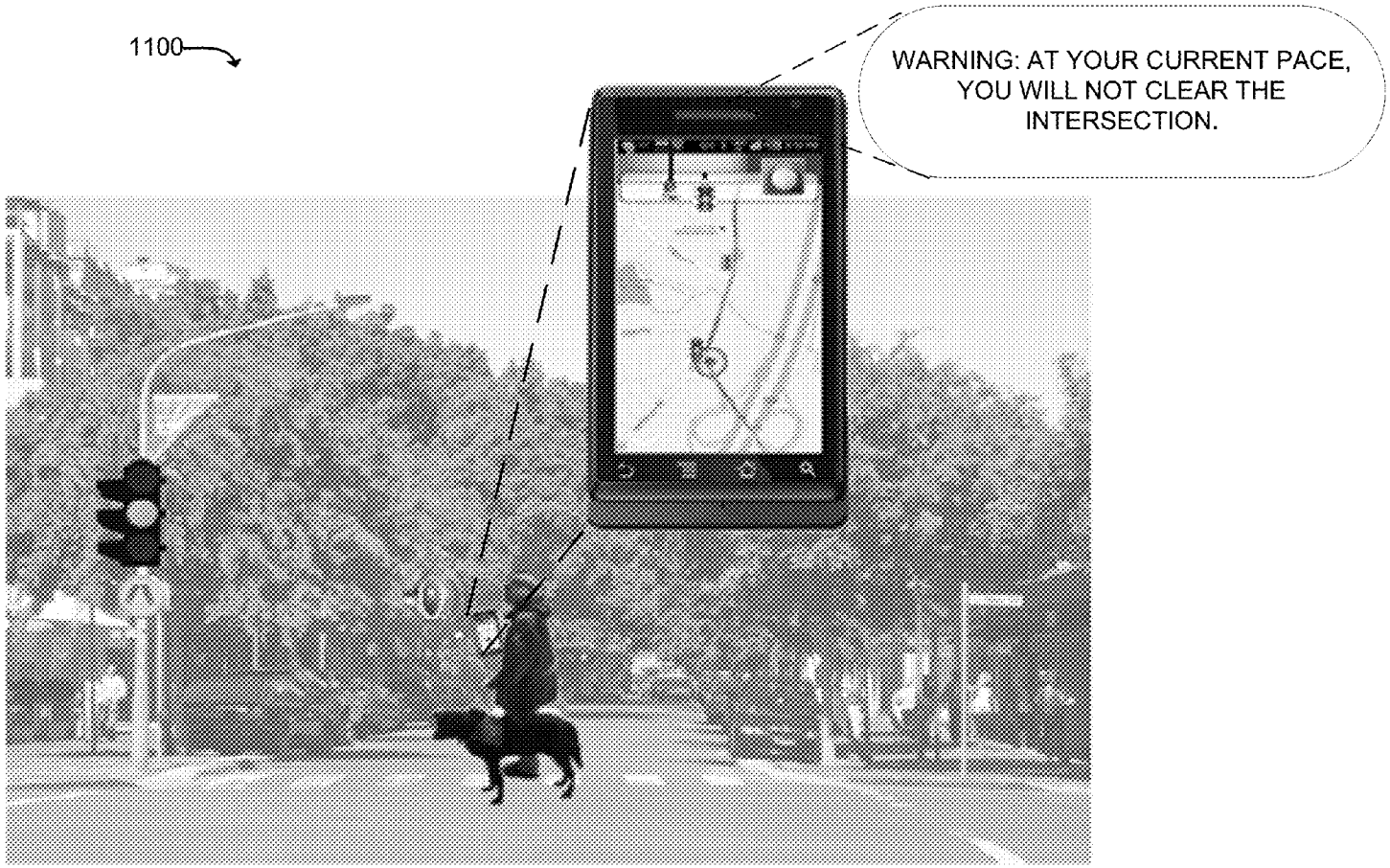

FIG. 11 is a diagram that illustrates another example 1100 for the process described above with respect to FIG. 7. For example 1100, assume that mobile device 230 uses travel information and traffic flow data to determine travel optimization data and outputs one or more visual and/or audible alerts as described above with respect to blocks 715-730. Moreover, assume that a blind user is attempting to cross a particular intersection. Mobile device 230 may determine that the user is attempting to cross the particular intersection and, based on the determined travel optimization data, mobile device 230 may determine that, at the user's current pace, the user will not cross the intersection when the status of the traffic light changes. Mobile device 230 may issue an audible alert indicating to the user that, at the user's current pace, the traffic light will change prior to the user crossing the intersection. Additionally, the audible alert may include information regarding how fast the user must travel to cross the intersection prior to the traffic light changing and/or information suggesting that the user not attempt to cross the intersection.

The foregoing description provides illustration and description, but is not intended to be exhaustive or to limit the embodiments to the precise form disclosed. Modifications and variations are possible in light of the above teachings or may be acquired from practice of the implementations. For example, while the above description focused on providing information regarding traffic lights to mobile devices, implementations, described herein, are equally applicable to providing other types of information from other types of devices to devices other than a mobile device.

As used herein, the term device is intended to be broadly interpreted to refer to hardware or a combination of hardware and software, such as software executed by a processor.

It will be apparent that systems and methods, as described above, may be implemented in many different forms of software, firmware, and hardware in the implementations illustrated in the figures. The actual software code or specialized control hardware used to implement these systems and methods is not limiting of the implementations. Thus, the operation and behavior of the systems and methods were described without reference to the specific software code—it being understood that software and control hardware can be designed to implement the systems and methods based on the description herein.

Even though particular combinations of features are recited in the claims and/or disclosed in the specification, these combinations are not intended to limit the disclosure of the possible implementations. In fact, many of these features may be combined in ways not specifically recited in the claims and/or disclosed in the specification. Although each dependent claim listed below may directly depend on only one other claim, the disclosure of the possible implementations includes each dependent claim in combination with every other claim in the claim set.

No element, act, or instruction used in the present application should be construed as critical or essential unless explicitly described as such. Also, as used herein, the article "a" is intended to include one or more items and may be used interchangeably with the phrase "one or more." Where only one item is intended, the term "one" or similar language is used. Further, the phrase "based on" is intended to mean "based, at least in part, on" unless explicitly stated otherwise.

What is claimed is:

1. A method comprising:

obtaining, by a device, travel information associated with a mobile device, the travel information including information identifying a route of travel of the mobile device;

identifying, by the device and based on the travel information, a first traffic light and a second traffic light located along the route of travel, regardless of whether the first traffic light and the second traffic light are in different directions of travel or are in a same direction of travel;

obtaining, by the device, information associated with the first traffic light, the first traffic light controlling a flow of traffic associated with a first location;

determining, by the device and based on the travel information, that the mobile device is located at a second location and is traveling toward the first location, the second location being different from the first location;

determining, by the device, a projected status of the first traffic light based on the information associated with the first traffic light and the travel information, the projected status of the first traffic light indicating a status of the first traffic light at a time the mobile device is projected to arrive at the first location;

providing, by the device, to the mobile device:

information identifying a current status of the first traffic light, and information identifying the projected status of the first traffic light;

determining, by the device, a projected status of the second traffic light based on information associated with the second traffic light, the projected status of the second traffic light being determined as the mobile device arrives at the first location, the second traffic light controlling a flow of traffic associated with a third location different from the first location and the second location, the projected status of the second traffic light indicating a status of the second traffic light at a time the mobile device is projected to arrive at the third location; and providing, by the device, to the mobile device:

information identifying an updated current status of the first traffic light, and information identifying the projected status of the second traffic light.

2. The method of claim 1, where the travel information further includes information identifying the second location and information identifying a speed of travel associated with the mobile device, and where determining the projected status of the first traffic light includes:

determining the projected status of the first traffic light further based on the information identifying the second location and the information identifying the speed of travel.

3. The method of claim 1, where obtaining the information associated with the first traffic light includes:

determining that the first traffic light is located along the route of travel, sending a request to the first traffic light based on the first traffic light being located along the route of travel, and receiving the information, associated with the first traffic light, from the first traffic light based on sending the request.

4. The method of claim 1, further comprising:

receiving, based on providing the information identifying the projected status of the first traffic light, updated travel information from the mobile device;

updating, based on the updated travel information, the projected status of the first traffic light to obtain an updated projected status of the first traffic light; and providing information identifying the updated projected status to the mobile device.

5. The method of claim 4, the method further comprising:

obtaining updated information associated with the first traffic light based on receiving the updated travel information; and where updating the projected status of the first traffic light includes:

updating the projected status of the first traffic light further based on the updated information associated with the first traffic light.

6. The method of claim 1, where the travel information includes information identifying a current location of the mobile device, the method further comprising:

determining travel information associated with another mobile device based on the current location of the mobile device; and providing one or more portions of the travel information associated with the other mobile device to the mobile device.

7. The method of claim 1, further comprising:

determining information for modifying an operation of the first traffic light based on the projected status of the first traffic light; and providing the information for modifying the operation of the first traffic light to the first traffic light to cause the first traffic light to be associated with a particular status as the mobile device arrives at the first location.

8. A device comprising:

a processor to:

determine travel information associated with the device, the travel information including information identifying a particular route that includes a first location, identify a first traffic light and a second traffic light located along the particular route, regardless of whether the first traffic light and the second traffic light are in different directions of travel or are in a same direction of travel, the first traffic light being associated with a second location included in the particular route, the second traffic light being associated with a third location included in the particular route, determine a projected status of the first traffic light based on the travel information, the projected status of the first traffic light indicating a status of the first traffic light at a time the device is projected to arrive at the second location, output to a user:

information identifying a current status of the first traffic light, and information identifying the projected status of the first traffic light, determine a projected status of the second traffic light associated with the third location, the projected status of the second traffic light being determined as the device arrives at the first location, the projected status of the second traffic light indicating a status of the second traffic light at a time the device is projected to arrive at the third location, and output, after determining the projected status of the second traffic light, to the user:

information identifying an updated current status of the first traffic light, and information identifying the projected status of the second traffic light.

9. The device of claim 8, where, when outputting the information identifying the updated current status of the first traffic light and the information identifying the projected status of the second traffic light, the processor is further to at least one of:

output a visual alert to the user, output an audible alert to the user, or output a physical alert to the user.

10. The device of claim 9, where the processor is further to:

output the visual alert, the projected status of the first traffic light being associated with a time period, the time period corresponding to a portion of an amount of time to travel between the first location and the third location, the updated current status of the first traffic light being associated with another time period corresponding to a different portion of the amount of time, where, when outputting the visual alert, the processor is further to:

cause information identifying a current location of the device, the information identifying the updated current status of the first traffic light, information identifying the first traffic light, information identifying the second traffic light, and the information identifying the projected status of the second traffic light to be displayed on a display associated with the device.

11. The device of claim 10, where the processor is further to:

determine updated travel information associated with the device, the updated travel information being based on the device being at a different location along the particular route, and cause the information identifying the current location of the device, the information identifying the updated current status of the first traffic light, the information identifying the first traffic light, the information identifying the second traffic light, and the information identifying the projected status of the second traffic light, displayed on the display associated with the device, to be modified based on the updated travel information.

12. The device of claim 11, where the processor is further to:

determine, based on the updated travel information, an updated projected status of the first traffic light, and output information identifying the updated projected status.

13. The device of claim 8, where the travel information includes one or more of:

information identifying a current location of the device, or information identifying a speed of travel of the device.

14. The device of claim 8, where the processor is further to:

transmit the travel information to a device associated with the first traffic light located at the second location, and where, when determining the projected status of the first traffic light, the processor is to:

receive information indicating the projected status of the first traffic light from the device associated with the first traffic light located at the second location.

15. A non-transitory computer-readable medium storing instructions, the instructions comprising:

one or more instructions that, when executed by a processor, cause the processor to:

obtain travel information associated with a mobile device, the travel information including information identifying a route of travel, identify, based on the travel information, a first traffic light and a second traffic light located along the route of travel, regardless of whether the first traffic light and the second traffic light are in different directions of travel or are in a same direction of travel, obtain information associated with the first traffic light, the first traffic light controlling a flow of traffic associated with a first location, determine, based on the travel information, that the mobile device is located at a second location and is traveling toward the first location, the second location being different from the first location, determine a projected status of the first traffic light based on the information associated with the first traffic light and the travel information, the projected status of the first traffic light indicating a status of the first traffic light at a time the mobile device is projected to arrive at the first location, transmit information identifying the projected status to the mobile device, determine a projected status of the second traffic light based on information associated with the second traffic light, the projected status of the second traffic light being determined as the mobile device arrives at the first location, the second traffic light controlling a flow of traffic associated with a third location different from the first location and the second location, the projected status of the second traffic light indicating a status of the second traffic light at a time the mobile device is projected to arrive at the third location; and provide, as the mobile device arrives at the first location, to the mobile device:

information identifying an updated current status of the first traffic light, and information identifying the projected status of the second traffic light.

16. The non-transitory computer-readable medium of claim 15, where the travel information includes further information identifying the second location and information identifying a speed of travel associated with the mobile device, and where the one or more instructions to determine the projected status of the first traffic light include:

one or more instructions to determine the projected status of the first traffic light further based on the information identifying the second location and the information identifying the speed of travel.

17. The non-transitory computer-readable medium of claim 15, where the instructions further comprise:

one or more instructions to determine, based on the travel information, the route of travel; and where the one or more instructions to obtain the information associated with the first traffic light include:

one or more instructions to determine that the first traffic light is associated with the route of travel, and one or more instructions to obtain the traffic light information from the first traffic light based on the first traffic light being associated with the route of travel.

18. The non-transitory computer-readable medium of claim 17, where the one or more instructions to determine the route of travel include:

one or more instructions to extract an identifier from the travel information, one or more instructions to obtain historical information associated with the mobile device based on the identifier, and one or more instructions to determine the route of travel based on the historical information.

19. The non-transitory computer-readable medium of claim 15, where the instructions further comprise:

one or more instructions to determine travel data associated with another mobile device; and one or more instructions to determine whether the mobile device is associated with a first level of service or a second level of service; and where the one or more instructions to transmit the information identifying the projected status include:

one or more instructions to transmit one or more portions of the travel data associated with the other mobile device when the mobile device is associated with the first level of service, the one or more portions of the travel data associated with the other mobile device not being transmitted when the mobile device is associated with the second level of service.

20. The non-transitory computer-readable medium of claim 15, where the instructions further comprise:

one or more instructions to determine information for modifying an operation of the first traffic light based on the projected status of the first traffic light; and one or more instructions to transmit the information for modifying the operation of the first traffic light, to the first traffic light, to cause the first traffic light to be associated with a particular status as the mobile device arrives at the first location.

* * * * *